United States Patent [19]

Admiraal

[11] 4,055,961

[45] Nov. 1, 1977

[54] DEVICE FOR LIQUEFYING GASES

[75] Inventor: Petrus Simon Admiraal, Eindhoven, Netherlands

[73] Assignee: U.S. Philips Corporation, New York, N.Y.

[21] Appl. No.: 627,106

[22] Filed: Oct. 30, 1975

Related U.S. Application Data

[63] Continuation of Ser. No. 494,393, Aug. 5, 1974, abandoned.

[30] Foreign Application Priority Data

Aug. 21, 1973 Netherlands ..... 7311471

[51] Int. Cl.[2] ..... F17C 13/00

[52] U.S. Cl. ..... 62/54; 55/66; 62/40

[58] Field of Search ..... 62/22, 39, 34, 38, 36, 62/40, 9, 11, 32, 42, 43, 41, 54; 55/66

[56] References Cited

U.S. PATENT DOCUMENTS

| | | | |
|---|---|---|---|
| 2,932,173 | 4/1960 | Mordhorst et al. | 62/22 |
| 3,098,732 | 7/1963 | Dennis | 62/40 |
| 3,180,709 | 4/1965 | Yewdall | 62/38 |
| 3,250,079 | 5/1966 | Davis et al. | 62/38 |
| 3,354,662 | 11/1967 | Daunt | 62/40 |
| 3,389,565 | 6/1968 | Ergenc | 62/38 |
| 3,473,342 | 10/1969 | Leyarovski et al. | 62/22 |
| 3,613,387 | 10/1971 | Collins | 62/39 |
| 3,792,591 | 2/1974 | Collins | 62/22 |
| 3,864,926 | 2/1975 | Collins | 62/22 |

*Primary Examiner*—Frank W. Lutter
*Assistant Examiner*—Frank Sever
*Attorney, Agent, or Firm*—Frank R. Trifari; Rolf E. Schneider

[57] ABSTRACT

A liquefactor includes a refrigeration stage for cooling a compressed gaseous body, and a first duct containing a first Joule-Thompson valve for connecting the refrigeration stage to a collecting container for use when the gaseous body comprises a single gas. A second duct parallelly connects the refrigeration stage to the collecting container and contains a second Joule-Thompson valve for use when the gaseous body comprises a mixture of two gases to be separated.

3 Claims, 1 Drawing Figure

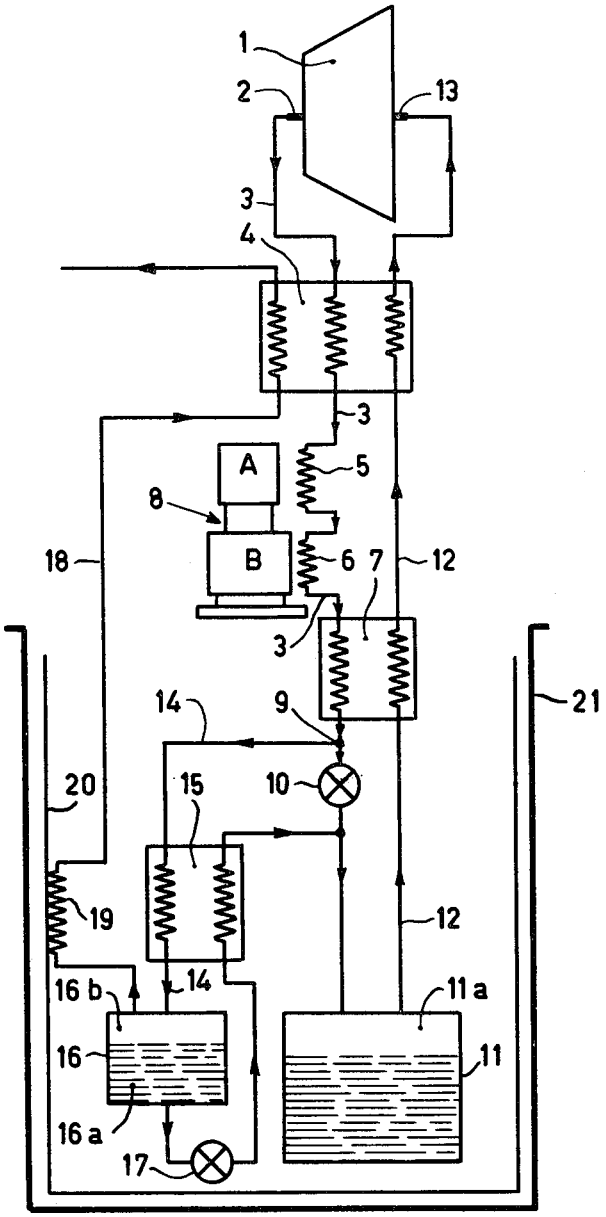
1
2
13
3
4
3
A
5
8
B
6
7
12
18
3
21
14
9
20
15
10
19
12
16 b
14
11 a
16
11
16 a
17

DEVICE FOR LIQUEFYING GASES

This is a continuation of application Ser. No. 494,393, filed Aug. 5, 1974, now abandoned.

BACKGROUND OF THE INVENTION

This invention relates to known devices for liquefying gases condensing at very low temperature, such as helium, hydrogen and neon, such devices including an inlet duct for high-pressure gas incorporating one or more pre-cooling devices and one or more counter-flow heat-exchangers, in which a high-pressure gas cools down below its inversion temperature associated with said pressure, also included is an outlet communicating with a pressure-reduction device, the outlet thereof opening into a collecting container for condensed gas comprising a vapour space having an outlet duct for low-pressure gas incorporating the counter-flow heat-exchanger (exchangers).

The high-pressure gas which is pre-cooled below the associated inversion temperature is throttled to a substantially lower pressure in the pressure-reduction device, its temperature then decreasing because of isenthalpic expansion (Joule-Kelvin effect). Because the values of the temperature and the pressure after departure from the pressure-reduction device are below the critical temperature and pressure values, at least part of the gas has been liquefied. The condensed gas flows into the collecting container. The expanded and non-condensed gas is normally returned, via counter-flow heat-exchangers, to the suction side of a compression installation which supplies the high-pressure gas.

Dewar vessels filled with liquid nitrogen, neon, hydrogen or even helium, for example, are used as the cooling device for pre-cooling the gas under high pressure. Use is sometimes also made of expansion machines in which a branched-off part of the high-pressure gas flow expands while performing mechanical work, cold thus being developed by which the high-pressure gas flow is pre-cooled.

Refrigerators are also often used for precooling, notably cold-gas refrigerators. For example, the article "A gas refrigerating machine for temperatures down to 20° K and lower" (Philips Technical Review, Volume 26, 1965, No. 1) describes helium liquefactor (FIG. 12) in which the high-pressure helium is pre-cooled in two stages (to approximately 80° K and approximately 15° K) by means of a three-space cold-gas refrigerator.

As is known in practice, not only liquefaction of gases such as helium, hydrogen and neon occurs, but the constituents of gas mixtures such as helium-neon mixtures also may have to be separated; this is normally effected in typical gas separation installations.

The invention has for its object to provide an improved device of the kind set forth by a structurally simple extension of the known device, so that not only single gases can be liquefied, but that also gas mixtures can be separated into the individual constituents.

SUMMARY OF THE INVENTION

The device according to the invention is characterized in that it comprises an auxiliary duct including one or more further heat-exchangers, one end of the said auxiliary duct communicating, parallel to the pressure-reduction device, with the outlet of the inlet duct, the other end of the auxiliary duct communicating with a separating container for separating a mixture of constituents into a first liquid constituent and a second gaseous constituent. The separating container has a liquid space communicating with a further pressure-reduction device, the outlet of which also opens, via the further heat exchanger (exchangers), into the collecting container for liquefied gas.

A preferred embodiment of the device according to the invention is characterized in that the separating container comprises an outlet duct for the gaseous constituent in which one or more of the counter-flow heat-exchangers are also incorporated. Because the heat-exchangers are also incorporated in the outlet duct for gaseous constituent, the thermal efficiency of the device is enhanced.

A further preferred embodiment of the device according to the invention is characterized in that the further heat-exchanger is arranged in the collecting container for liquefied gas. It is thus achieved that the constituent which is separated in the separating container from a gas mixture in the liquid phase has a higher purity, that is to say a lower content of gaseous constituent dissolved in the liquid.

The invention will be described in detail hereinafter with reference to the drawing which diagrammatically shows an embodiment of the combined liquefaction/gas separation device.

DETAILED DESCRIPTION OF THE PREFERRED EMBODIMENT

The reference numeral 1 denotes a compressor installation having an outlet 2 which communicates with an or first duct 3 for high-pressure gas, inlet meaning inlet to the liquefaction/gas separation portion of the apparatus. Inlet duct 3 incorporates a counter-flow heat-exchanger 4, heat-exchangers 5 and 6, and a counter-flow heat-exchanger 7. In heat-exchangers 5 and 6 high-pressure gas can exchange heat at a higher and a lower temperature level with the two stages A and B of a cold-gas refrigerator 8 serving as a pre-cooling device. Outlet 9 of inlet duct 3 communicates with a throttle valve 10 which serves as the pressure-reduction device and which has an outlet which opens into a collecting container 11 for condensed gas.

The vapor space **11*a* of this container comprises an outlet duct 12 for low-pressure gas which also incorporates the counter-flow heat-exchangers 7 and 4. Outlet duct 12 communicates with the suction inlet 13 of the compressor installation 1**.

The part of the device described thus far constitutes a known liquefaction system. The outlet 9 of inlet duct 3 for high-pressure gas has connected thereto, parallel to the throttle valve 10, an auxiliary duct 14 incorporating a counter-flow heat-exchanger 15. Auxiliary duct 14 communicates with a separating container 16 in which constituents of a mixture can be separated into a liquefied constituent and another constituent which remains in the gaseous phase. Liquid space **16*a* of separating container 16 communicates with a throttle valve 17 which serves as a pressure-reduction device whose outlet also opens into collecting container 11 via counter-flow heat-exchanger 15**.

Gas space **16*b* of separating container 16 has connected thereto an outlet duct 18 for the gaseous constituent. Counter-flow heat-exchanger 4 is also incorporated therein. Outlet duct 18 furthermore incorporates a heat-exchanger 19 for cooling a radiation shield 20 inside an envelope 21** for the lower-temperature part of the device.

The operation of the device is as follows. When a pure gas (helium, neon, hydrogen) is to be liquefied, throttle valve 17 remains closed. Counter-flow heat-exchanger 15 and separating container 16 then also remain inactive. The gas is compressed to a high-pressure by compressor installation 1 and is subsequently fed to inlet duct 3, in which it is cooled down in counter-flow heat-exchanger 4 by low-pressure gas originating from collecting container 11. The high-pressure gas is further cooled down in the heat-exchanger 5 and 6 by the stages A and B of the cold-gas refrigerator 8, and also in the counter-flow heat-exchanger 7. The high-pressure, pre-cooled gas expands to a substantially lower pressure in throttle valve 10. The liquid formed is collected in collecting container 11, while the low-pressure gas is drawn off, via duct 12, by compressor installation 1 so as to be compressed to a high pressure again. If desired, high-pressure gas can be delivered directly from cylinders.

If a mixture is to be separated into its constituents, throttle valve 10 is closed and throttle valve 17 is opened. The constituent having the highest boiling point must then be pre-cooled to below its relevent inversion temperature. A helium-neon mixture is compressed by compressor installation 1 to, for example, 25 atmospheres and is cooled down to approximately 32° K by way of counter-flow heat-exchanger 4, heat-exchangers 5 and 6. Further cooling down to approximately 25° K is effected in the counter-flow heat-exchangers 7 and 15. The neon constituent has then been mainly liquefied. The separation of the liquid neon and the gaseous helium is effected in separating container 16. The gaseous helium is discharged via duct 18. It gives off cold in heat-exchanger 19 to radiation shield 20 and to high-pressure gas mixture in counter-flow heat-exchanger 4.

The liquid neon expands in throttle valve 17 and takes up heat in counter-flow heat-exchanger 15 from high-pressure mixture. Consequently, on the one hand the mixture is thus further cooled, while on the other hand solidification of liquid neon originating from the throttle valve 17 is prevented. After having passed counter-flow heat exchanger 15, the low-pressure liquid neon flows to collecting container 11. Low-pressure gas mixture is drawn-off by compressor installation 1, inlet meaning inlet to the liquefaction/gas separation portion of the apparatus. The purity of the liquid neon thus obtained can be further enhanced by incorporating counter-flow heat-exchanger 15 in collecting container 11.

What is claimed is:

1. Apparatus for selectively liquifying one component contained in a gaseous body comprising no more than two components which comprises means for compressing a portion of said gaseous body, means for feeding said pressurized portion to a refrigeration stage for cooling to a temperature below the inversion temperature of said one component at the pressure to which said portion is so compressed, a collecting container having liquid and vapor spaces, a first duct connecting said refrigeration stage to said collecting container, a first Joule-Thompson valve in said first duct for selectively reducing the pressure of said cooled pressurized portion when said gaseous body comprises only one component, a separation container having liquid and vapor spaces, a second duct connecting a point of said first duct, between said refrigeration stage and said first Joule-Thompson valve, to said separation container, a third duct connecting the liquid space of said separation container to said first duct at a point between said first Joule-Thompson valve and said collecting container, a second Joule-Thompson valve in said third duct functioning to selectively reduce the pressure of the liquid part of said cooled pressurized portion when said gaseous body comprises two components, means to exchange heat in counterflow relationship between said second duct and a section of said third duct between said second Joule-Thompson valve and said first duct, and a fourth duct connecting the vapor space of the collecting container to said compressing means, for feeding vapor from said vapor space to said compressing means.

2. Apparatus according to claim 1, which includes a fifth duct leading from the vapor space of said separation container for conducting vapor from said vapor space, a section of said fifth duct being positioned in counter-flow heat exchange relationship with said refrigeration stage.

3. Apparatus according to claim 1, in which a selection of said fourth duct between the vapor space of the collecting container and said compressing means is positioned in counter-flow heat-exchange relationship with said refrigeration stage.

* * * * *

UNITED STATES PATENT AND TRADEMARK OFFICE

CERTIFICATE OF CORRECTION

PATENT NO. : 4055,961

DATED : Nov. 1, 1977

INVENTOR(S) : PETRUS SIMON ADMIRAAL

It is certified that error appears in the above-identified patent and that said Letters Patent are hereby corrected as shown below:

Column 2, line 31, after "an" (second occurrence) insert --inlet--

Column 3, lines 45-47, delete ";inlet meaning inlet to liquefaction/gas separation portion of the apparatus"

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*